US008111126B2

(12) United States Patent
Li et al.

(10) Patent No.: US 8,111,126 B2
(45) Date of Patent: Feb. 7, 2012

(54) OVER-CURRENT PROTECTION DEVICE AND MANUFACTURING METHOD THEREOF

(75) Inventors: Wen Chin Li, Jia-Yi County (TW); Hui Ming Feng, Taoyuan County (TW)

(73) Assignee: Inpaq Technology Co., Ltd., Miaoli (TW)

( * ) Notice: Subject to any disclaimer, the term of this patent is extended or adjusted under 35 U.S.C. 154(b) by 308 days.

(21) Appl. No.: 12/469,504

(22) Filed: May 20, 2009

(65) Prior Publication Data

US 2010/0182121 A1 Jul. 22, 2010

(30) Foreign Application Priority Data

Jan. 16, 2009 (TW) ..... 98101467 A

(51) Int. Cl.
*H01C 7/10* (2006.01)

(52) U.S. Cl. ..... 338/22 R

(58) Field of Classification Search ..... 338/22 R, 338/307–309, 327, 332
See application file for complete search history.

(56) References Cited

U.S. PATENT DOCUMENTS

| | | | | |
|---|---|---|---|---|
| 4,660,017 | A * | 4/1987 | Momoki et al. | 338/21 |
| 5,075,665 | A * | 12/1991 | Taira et al. | 338/21 |
| 5,896,264 | A * | 4/1999 | Bijlenga et al. | 361/106 |
| 6,593,844 | B1 * | 7/2003 | Iwao et al. | 338/22 R |
| 6,717,506 | B2 * | 4/2004 | Ishii | 338/22 R |
| 7,573,008 | B2 * | 8/2009 | Yamashita et al. | 219/553 |
| 7,696,677 | B2 * | 4/2010 | Ito et al. | 310/365 |
| 2002/0050921 | A1 * | 5/2002 | Groen et al. | 338/309 |
| 2002/0089409 | A1 * | 7/2002 | Ishii | 338/22 R |
| 2003/0150741 | A1 * | 8/2003 | Wu | 205/205 |
| 2006/0152330 | A1 * | 7/2006 | Kang et al. | 338/22 R |
| 2010/0182121 | A1 * | 7/2010 | Li et al. | 338/22 R |

FOREIGN PATENT DOCUMENTS

CN 2005200114251.9 6/2006

OTHER PUBLICATIONS

Office Action with cited reference issued on Feb. 24, 2011 from the Chinese counterpart application 200910008876.X.

* cited by examiner

*Primary Examiner* — James Harvey
(74) *Attorney, Agent, or Firm* — WPAT, P.C.; Anthony King

(57) ABSTRACT

An over-current protection device comprises a PTC material layer, a first electrode layer, a second electrode layer, a first side electrode and a second side electrode. The PTC material layer is sandwiched between the first electrode layer and the second electrode layer. The first side electrode and the second side electrode are respectively disposed on two opposite side surfaces of the PTC material layer, and are respectively connected to the first electrode layer and the second electrode layer. Furthermore, the first side electrode and the second side electrode are respectively extended to four surfaces adjacent and perpendicular to the two side surfaces.

17 Claims, 5 Drawing Sheets

OVER-CURRENT PROTECTION DEVICE AND MANUFACTURING METHOD THEREOF

BACKGROUND OF THE INVENTION (A) Field of the Invention

The present invention relates to an over-current protection device and a manufacturing method thereof, and more particularly, to an SMD (surface mount device) over-current protection device with a positive temperature coefficient (PTC) characteristic.

(B) Description of the Related Art

The resistance of a positive temperature coefficient conductive material is sensitive to temperature variation and can be kept extremely low during normal operation so that the circuit can operate normally. However, if an over-current or an over-temperature event occurs, the resistance will immediately increase to a high resistance state (e.g., above $10^4$ ohm.) Therefore, the over-current will be eliminated and the objective to protect the circuit device will be achieved. Consequently, PTC devices have been commonly integrated into various circuitries so as to prevent damage caused by over-current events.

FIG. 1 shows an over-current protection electrical apparatus 1 disclosed by U.S. Pat. No. 5,852,397. Metallic foil electrodes 11 are respectively attached to the upper surface and lower surface of a PTC material layer 10. Next, the surfaces of the metallic foil electrodes 11 are etched to form long grooves 12 so that each of the metallic foil electrodes 11 is divided into two electrode portions of different sizes. Through holes are drilled on the left and right edges of the electrical apparatus 1, and each of the through holes is respectively filled with a conductive rod 13 by plating. Therefore, all the electrode portions on a side are electrically connected to each other along a vertical direction.

FIG. 2 is a perspective diagram of an SMD electrical apparatus disclosed by R.O.C U.S. Pat. No. 415,624. The SMD electrical apparatus 2 has a PTC material layer 10, and metallic foil layers 21 are respectively attached to the upper surface and lower surface of the PTC material layer 10. Next, long slots are respectively formed on the left edge of the upper metallic foil layer 21 and the right edge of the lower metallic foil layer 21 by etching. Insulating films 22 are respectively coated on the upper and lower metallic foil layers 21, and the slots are also filled with the insulating films 22. Subsequently, metallic foil electrodes 23 are respectively attached to the upper and lower insulating films 22. Similarly, an etching process is used to remove the middle portions of the metallic foil electrodes 23, and symmetric left and right portions are left on two sides.

Through holes are formed on the left and right edges of the SMD electrical apparatus 2. Conductive layers 24 are plated on the surfaces of the through holes so that the two left metallic foil electrodes 23 are connected to the lower metallic foil layer 21 and two right metallic foil electrodes 23 are connected to the upper metallic foil layer 21.

The aforesaid prior arts all utilize methods similar to the manufacturing processes of printed circuit board, such as exposure, development, etching, drilling and plating. Therefore, not only do the prior arts require expensive equipment and complicated processes to manufacture, but also produce harmful etching liquids or plating liquids that pollute the environment.

In addition, regarding the electrical apparatus 1 and the SMD electrical apparatus 2, the external electrodes and internal electrodes (or conductive rods and conductive layers) have smaller contact areas, so the electrical resistance is raised. Considering the ever-progressing requirements for reducing the size of electrical devices, the contact areas or the diameters of the through holes cannot be effectively reduced due to their inherent limitations. The prior arts are therefore not suitable for manufacturing miniature over-current protection devices.

Also, in the prior art, the two sides of the electrical apparatus 1 (the surface perpendicular to the upper and lower metallic foil layers, and the surface along the lengthwise direction of the main body) and the SMD electrical apparatus 2 have stacked layers exposed to the atmosphere. Consequently, moisture penetrates the PTC material layer and the upper and lower metallic foil layers so that the electrical reliability is affected.

SUMMARY OF THE INVENTION

One aspect of the present invention is to provide an over-current protection device. The device has a simple structure, and its main body is completely covered. It is indeed an inexpensive, small-scaled, and reliable electrical device.

Another aspect of the present invention is to provide a method for manufacturing an over-current protection device. It utilizes easily implemented and low pollution manufacturing processes, so it can reduce the manufacturing cost and environmental pollution.

According to the aforesaid aspect, the present invention provides an over-current protection device. An over-current protection device comprises a PTC material layer, a first electrode layer, a second electrode layer, a first side electrode and a second side electrode. The PTC material layer is sandwiched between the first electrode layer and the second electrode layer. The first side electrode and the second side electrode are respectively disposed on two opposite side surfaces of the PTC material layer, and are respectively connected to the first electrode layer and the second electrode layer. Furthermore, the first side electrode and the second side electrode are respectively extended to four surfaces adjacent and perpendicular to the two side surfaces.

A body insulating layer is further disposed on the four surfaces of the device not covered by the first side electrode and the second side electrode.

The present invention provides a method for manufacturing an over-current protection device, which comprises the steps of: providing a PTC material layer; respectively forming a first electrode layer and a second electrode layer on upper and lower surfaces of the PTC material layer; cutting the multilayer structure of the PTC material layer, the first electrode layer and the second electrode layer into a plurality of main body units; and dipping each of the main body units into a conductive material to form a pair of opposite side electrodes.

The present invention further comprises a step of disposing a body insulating layer on the surfaces of the device not covered by the first side electrode and the second side electrode.

The present invention further comprises a step of disposing a solderable metal on the side electrodes by rolling plating.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

Figure 1:
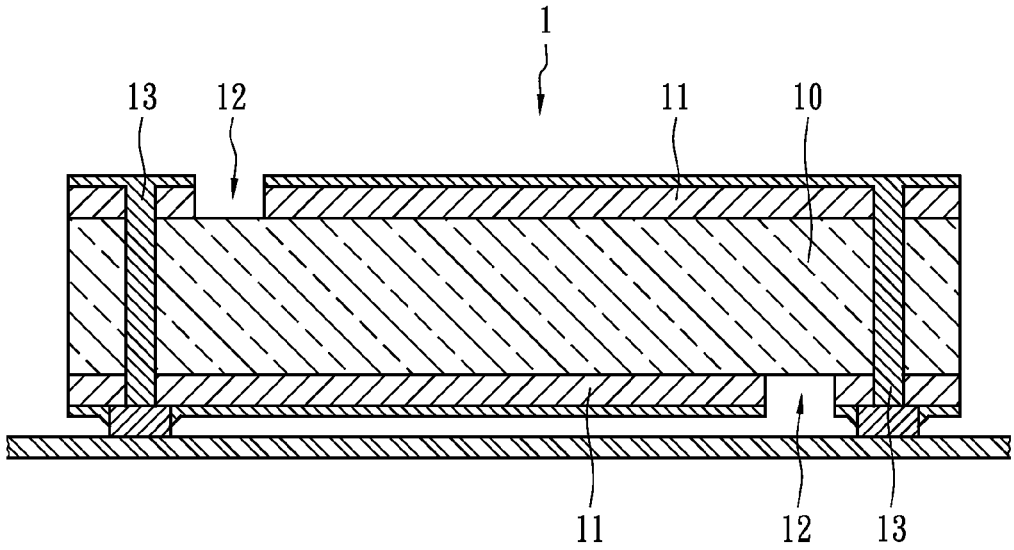
FIG. 1 (Prior Art)
FIG. 1 is a schematic diagram of a conventional over-current protection device.
Figure 2:
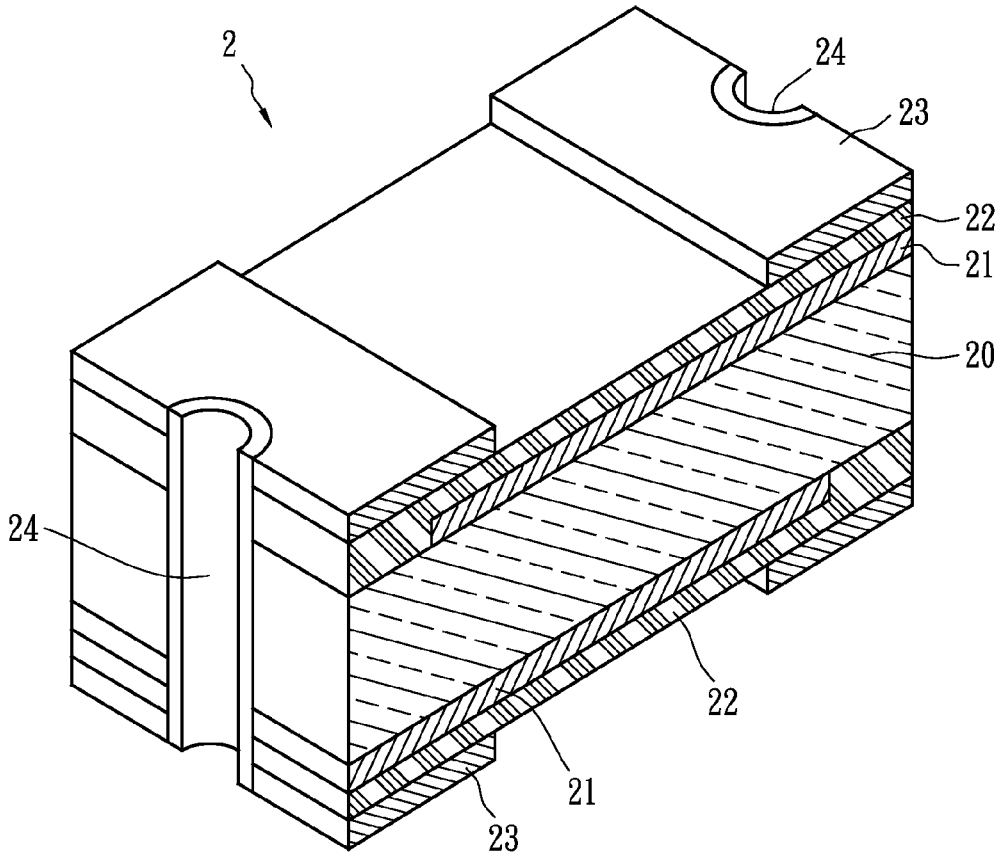
FIG. 2 (Prior Art)
FIG. 2 is a schematic diagram of another conventional over-current protection device.
Figure 3A:
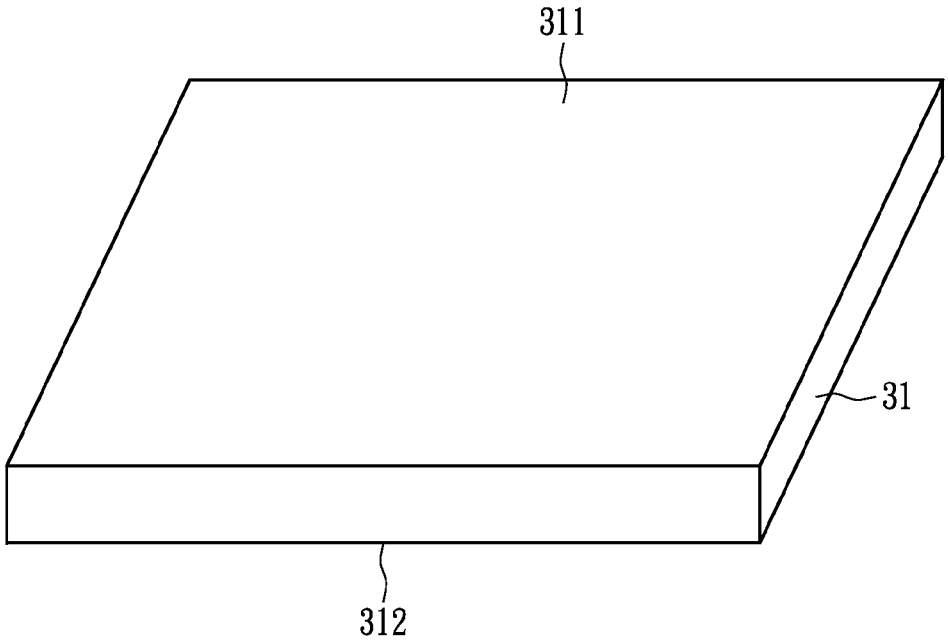
FIGS. 3A to 3G are schematic diagrams illustrating the manufacturing steps of an over-current protection device in accordance with the present invention.
Figure 3B:
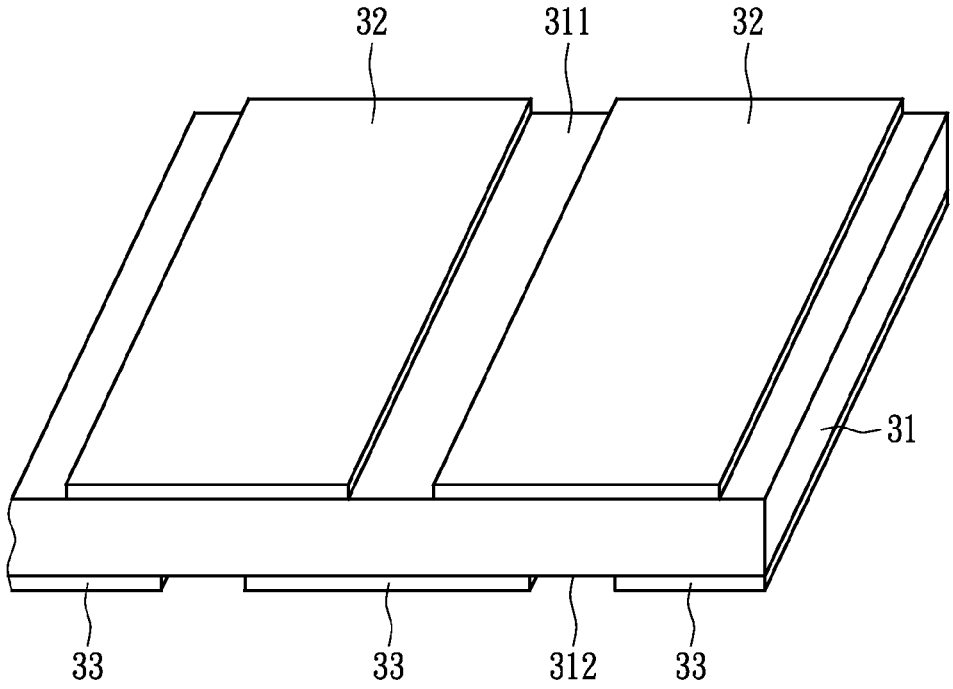

FIGS. 3A to 3G are schematic diagrams illustrating the manufacturing steps of an over-current protection device in accordance with the present invention. A PTC material layer (or substrate) 31 is provided. In this embodiment, a polymer PTC material is employed. Next, a first electrode layer 32 and a second electrode layer 33 are respectively formed on the upper surface 311 and lower surface 312 of the PTC material layer 31 by printing, as shown in FIG. 3B.

The upper surface 311 and lower surface 312 of the PTC material layer 31 can be given rough treatment such as shot-blasting or grinding so as to make the interfaces between the PTC material layer 31 and both the upper surface 311 and lower surface 312 have excellent bonding ability. The first electrode layer 32 and second electrode layer 33 are vertically disposed in a staggered manner. That is, the first electrode layer 32 and second electrode layer 33 respectively have a plurality of strip areas with a constant interval, and the strip areas do not align with each other vertically. The present invention can directly define the patterns of the first electrode layer 32 and second electrode layer 33 on the PTC material layer 31 by screen printing. In contrast, the prior arts utilize a photolithography process to define the patterns of the copper foils. The present invention is easily implemented, and has low cost on process. The material of the first electrode layer 32 and second electrode layer 33 is Au, Ag, Pt, Cu, Ni, carbon-type conductive material, or the mixture of the aforesaid several materials.

Figure 3C:
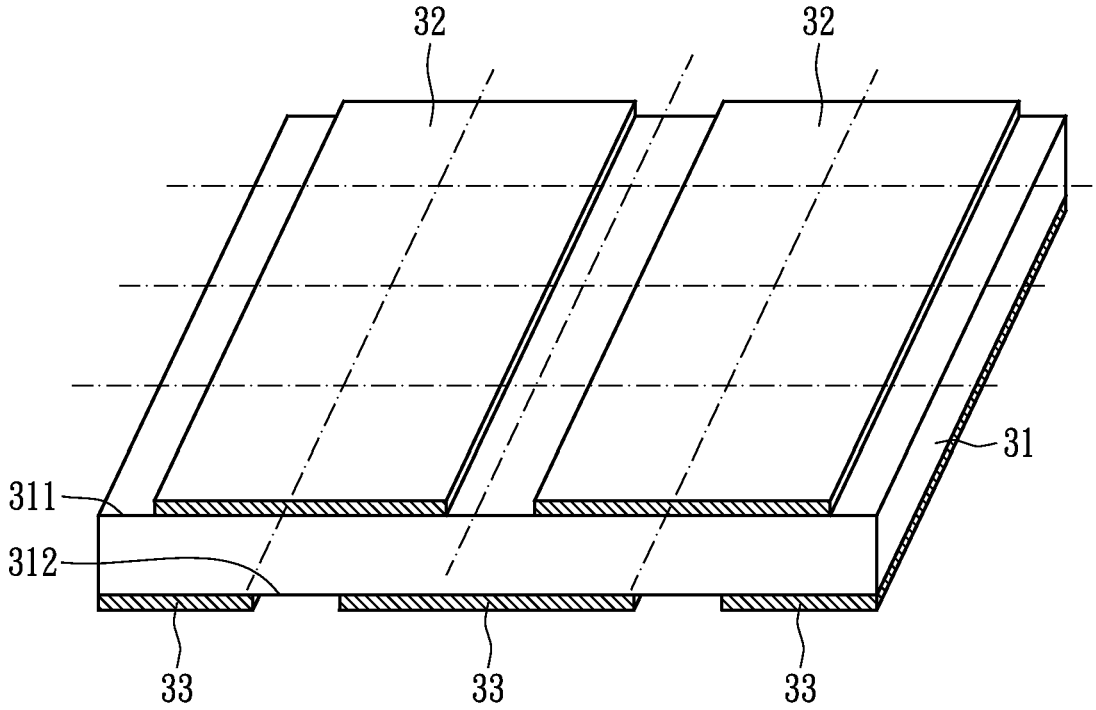

As shown in FIG. 3C, the stacked layer structure of the PTC material layer 31, the first electrode layer 32, and the second electrode layer 33 are finished. The structure can be divided into a plurality of main body units 39 along mesh cutting lines, as shown in FIG. 3C.

Figure 3D:
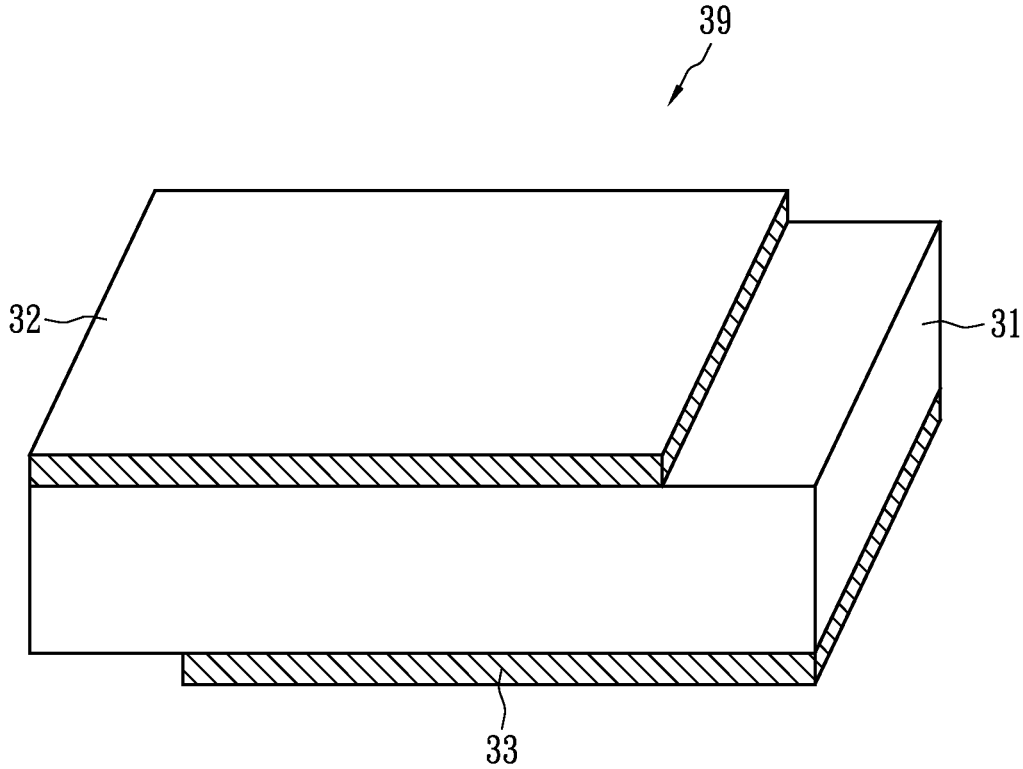

FIG. 3D shows a schematic diagram of the main body unit 39. The left sides of the first electrode layer 32 and the PTC material layer 31 are approximately aligned with each other. The right side of the first electrode layer 32 does not extend far enough to align with the right side of the PTC material layer 31. However, the right side of the second electrode layer 33 and the PTC material layer 31 are approximately aligned with each other. The left side of the second electrode layer 33 does not extend far enough to align with the left side of the PTC material layer 31.

Each of the main body units 39 is dipped in a conductive material such as silver or copper to create two opposing electrodes: a first side electrode 36 and a second side electrode 37. The first side electrode 36 and the second side electrode 37 are disposed on opposite side surfaces of the main body unit 39, and are respectively connected to the first electrode layer 32 and second electrode layer 33. The first side electrode 36 and the second side electrode 37 extend their margins from two opposite side surfaces to four surfaces which are adjacent to the side surfaces and mutually perpendicular to each other. Therefore, each of the side electrodes with five surfaces is formed. Compared with the side electrode with three surfaces of the prior arts, the over-current protection device of the present invention is more easily implemented in a subsequent SMD process.

Figure 3E:
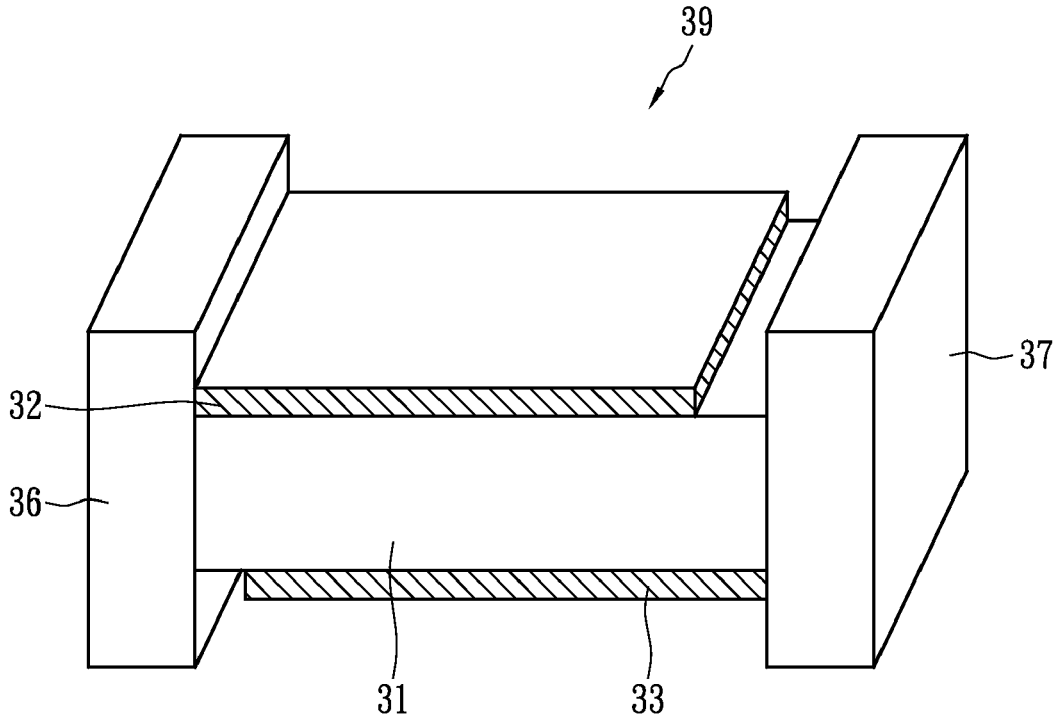
Figure 3F:
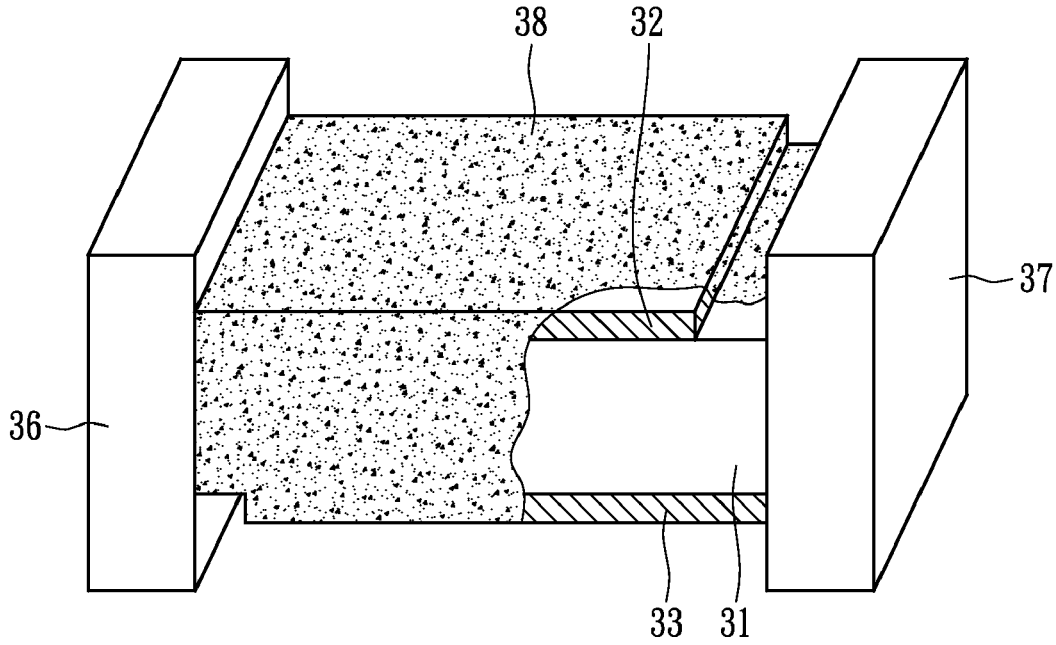

Referring to FIG. 3E, a body insulating layer 38 covers the main body unit 39. The portion of the first electrode layer 32 adjacent to the first side electrode 36 is not covered by the body insulating layer 38, and the portion of the second electrode layer 33 adjacent to the second side electrode 37 is not covered by the body insulating layer 38. Because the body insulating layer 38 can protect the main body unit 39 from moisture, the reliability of the over-current protection device 30 is improved.

Figure 3G:
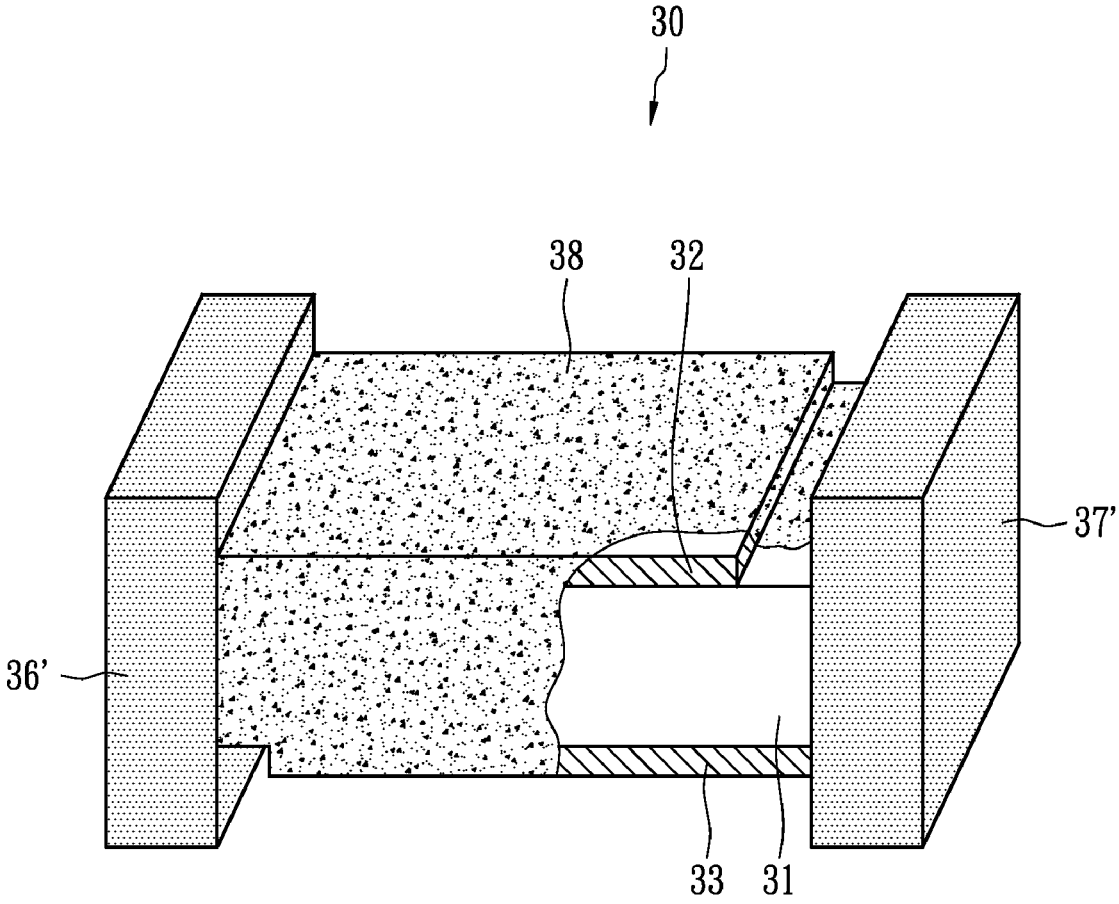

In order to improve the solderability of the first side electrode 36 and second side electrode 37 during subsequent SMD process, a solderable material is deposited on the surfaces by rolling plating. Therefore, the over-current protection device 30 has a preferably solderable first side electrode 36' and second side electrode 37', as shown in FIG. 3G. Ni, Sn, and Sn—Pb alloy are suitable for the solderable material.

In view of the descriptions of the aforesaid embodiments, the present invention includes many amendments and variations to these embodiments. Therefore, it is necessary to further refer to the scope of the following claims. In addition to the aforesaid detailed descriptions, the present invention can be widely applied to various other embodiments. The above-described embodiments of the present invention are intended to be illustrative only. Those skilled in the art may devise numerous alternative embodiments without departing from the scope of the following claims.

What is claimed is:

1. An over-current protection device, comprising:

a first electrode layer;

a second electrode layer;

a positive temperature coefficient (PTC) material layer sandwiched between the first electrode layer and the second electrode layer;

a first side electrode electrically connected to the first electrode layer;

a second side electrode electrically connected to the second electrode layer; and a body insulating layer disposed on the four surfaces of the device not covered by the first side electrode and the second side electrode, wherein the first side electrode and the second side electrode are disposed on two opposite side surfaces of the PTC material layer, and the first side electrode and the second side electrode are respectively extended to the four surfaces adjacent and perpendicular to the two side surfaces.

2. The over-current protection device of claim 1, wherein the material of the PTC material layer is a polymer PTC material.

3. A method for manufacturing an over-current protection device, comprising the steps of:

providing a PTC material layer;

respectively forming a first electrode layer and a second electrode layer on upper and lower surfaces of the PTC material layer;

cutting the stacked layer structure of the multilayer structure of the PTC material layer, the first electrode layer and the second electrode layer into a plurality of main body units;

dipping each of the main body units into a conductive material to form a pair of opposite side electrodes; and disposing a body insulating layer between the first side electrode and the second side electrode.

4. The over-current protection device of claim 1, wherein the first side electrode and the second side electrode are covered by a solderable material.

5. The over-current protection device of claim 4, wherein the solderable material is Ni, Sn, or Sn—Pb alloy.

6. The over-current protection device of claim 1, wherein the material of the first electrode layer and second electrode layer is Au, Ag, Pt, Cu, Ni, carbon-type conductive material, or the mixture of the aforesaid several materials.

7. The over-current protection device of claim 1, wherein a portion of the first electrode layer adjacent to the first side electrode is not covered by the body insulating layer, and a portion of the second electrode layer adjacent to the second side electrode is not covered by the body insulating layer.

8. The over-current protection device of claim 1, wherein each of the first side electrode and the second side electrode has five surfaces.

9. The method for manufacturing an over-current protection device of claim 3, wherein the two side electrodes are disposed on the two opposite side surfaces of the main body unit, and respectively are extended to four surfaces which are adjacent to the side surfaces and mutually perpendicular to each other.

10. The method for manufacturing an over-current protection device of claim 3, wherein one of the side electrodes is electrically connected to the first electrode layer, and the other of the side electrodes is electrically connected to the second electrode layer.

11. The method for manufacturing an over-current protection device of claim 3, further comprising a step of disposing a solderable material on the side electrodes by rolling plating.

12. The method for manufacturing an over-current protection device of claim 11, wherein the solderable material is Ni, Sn, or Sn—Pb alloy.

13. The method for manufacturing an over-current protection device of claim 3, further comprising a step of applying a rough treatment to the upper surface and the lower surface of the PTC material layer.

14. The method for manufacturing an over-current protection device of claim 3, wherein the material of the PTC material layer is a polymer PTC material.

15. The method for manufacturing an over-current protection device of claim 3, wherein the first electrode layer and second electrode layer have patterns respectively defined by a screen printing process.

16. The method for manufacturing an over-current protection device of claim 3, wherein the material of the first electrode layer and second electrode layer is Au, Ag, Pt, Cu, Ni, carbon-type conductive material, or the mixture of the aforesaid several materials.

17. The method for manufacturing an over-current protection device of claim 3, wherein the two opposite side electrodes are formed on the main body unit by silver dipping or copper dipping.

* * * * *